US007222442B2

(12) United States Patent
Hillyer et al.

(10) Patent No.: US 7,222,442 B2
(45) Date of Patent: May 29, 2007

(54) CONVERTIBLE SHOE AND SANDAL

(75) Inventors: Chris Hillyer, Goleta, CA (US); Jamison Horton, Santa Barbara, CA (US)

(73) Assignee: Deckers Outdoor Corp., Goleta, CA (US)

( * ) Notice: Subject to any disclaimer, the term of this patent is extended or adjusted under 35 U.S.C. 154(b) by 322 days.

(21) Appl. No.: 10/979,318

(22) Filed: Nov. 2, 2004

(65) Prior Publication Data

US 2006/0090374 A1 May 4, 2006

(51) Int. Cl.
*A43B 3/12* (2006.01)

(52) U.S. Cl. ..... 36/11.5; 36/10; 36/100

(58) Field of Classification Search ..... 36/11.5, 36/100, 101, 15, 7.1 R, 30 R, 10
See application file for complete search history.

(56) References Cited

U.S. PATENT DOCUMENTS

| | | | | |
|---|---|---|---|---|
| 2,205,091 | A | 6/1940 | Geffner | |
| 2,236,367 | A * | 3/1941 | Gruber | 36/101 |
| 3,336,683 | A * | 8/1967 | Schellkopf | 36/11.5 |
| 3,978,596 | A * | 9/1976 | Brown et al. | 36/11.5 |
| 4,030,212 | A * | 6/1977 | Ito | 36/11.5 |
| 4,172,330 | A * | 10/1979 | Kao | 36/11.5 |
| 4,300,294 | A * | 11/1981 | Riecken | 36/97 |
| 4,525,940 | A * | 7/1985 | Mochizuki | 36/8.1 |
| 4,706,392 | A | 11/1987 | Yang | |
| 4,864,736 | A * | 9/1989 | Bierk | 36/11.5 |
| 5,615,496 | A * | 4/1997 | Sharpstein | 36/11.5 |
| 5,737,853 | A * | 4/1998 | Smejkal | 36/11.5 |
| 6,092,305 | A | 7/2000 | Troy et al. | |
| 6,237,249 | B1 * | 5/2001 | Aguerre | 36/11.5 |
| 6,484,419 | B1 | 11/2002 | Rohde et al. | |
| 2001/0001350 | A1 * | 5/2001 | Aguerre | 36/31 |
| 2004/0128863 | A1 * | 7/2004 | Hong et al. | 36/100 |
| 2004/0255486 | A1 * | 12/2004 | Pawlus et al. | 36/10 |
| 2005/0252036 | A1 * | 11/2005 | Laska | 36/11.5 |
| 2006/0064902 | A1 * | 3/2006 | Ashton | 36/72 R |
| 2006/0075656 | A1 * | 4/2006 | Januszewski et al. | 36/11.5 |

* cited by examiner

*Primary Examiner*—Marie Patterson
(74) *Attorney, Agent, or Firm*—Greer Burns & Crain Ltd

(57) ABSTRACT

A convertible article of footwear has a primary article of footwear and a sandal that is removably inserted into the primary article of footwear. The primary article of footwear includes an outsole and an upper attached to the outsole. The sandal includes at least one strap. When the sandal is inserted into the primary article of footwear, it is disposed above the outsole, and forms a midsole of the primary article of footwear. When the sandal is removed from the primary article of footwear, the sandal can be worn independently of the primary article of footwear.

15 Claims, 2 Drawing Sheets

CONVERTIBLE SHOE AND SANDAL

FIELD OF THE INVENTION

The present invention relates to an article of footwear. More specifically, the invention relates to an article of footwear that is convertible from a primary article of footwear to another article of footwear.

BACKGROUND OF THE INVENTION

Footwear is usually designed to meet a user's specific needs. For example, casual shoes are designed for comfort, to be worn during daily activities. Sports shoes are designed for active sports. Sandals can be designed for active sports or leisurely activities. As a result, users typically have many different pairs of footwear for different needs. However, traveling or carrying several pairs of footwear can be an inconvenience.

Accordingly, there is a need for an article of footwear that can be used for multiple purposes.

SUMMARY OF THE INVENTION

In accordance with the invention, the above-listed needs are met or exceeded by a convertible article of footwear having a primary article of footwear and a sandal that is removably inserted into the primary article of footwear. The primary article of footwear includes an outsole and an upper attached to the outsole. The sandal also includes at least one strap. When the sandal is inserted into the primary article of footwear, it is disposed within the upper above the outsole, and forms a midsole of the primary article of footwear. When the sandal is removed from the primary article of footwear, the sandal can be worn independently of the primary article of footwear.

Another aspect of the invention is a sandal for removable insertion into a primary article of footwear. The sandal includes a sole having a storage structure and a receiving structure, and at least one strap connected to the sole for retaining a user's foot. When the sandal is disposed in the primary article of footwear, the strap is stored in the storage structure of the sole, and when the sandal is removed from the primary article of footwear, the strap can be moved to the receiving structure of the sole. The sandal can be worn independently of the primary article of footwear.

In another embodiment of the invention, a sandal for removable insertion into a primary article of footwear having an outsole and an upper is provided. The sandal includes a sole and at least one strap associated with the sole for retaining a user's foot. When the sandal is removably inserted into the primary article of footwear and disposed above the outsole, the sandal forms a midsole of the primary article of footwear, and when the sandal is removed from the primary article of footwear, the sandal can be worn independently of the primary article of footwear.

Another feature of the invention is a strapping system for a sandal having a sole including a heel portion and a forefoot portion. The sandal includes a sole having a storage structure at a peripheral edge of the sole and a receiving structure at a forefoot portion of the sole. The sandal also includes at least one strap associated with the sole. The strap is stored in the storage structure in a stored position, and is received at the receiving structure in a wearing position. When the strap is in the wearing position, it retains a foot in the sandal.

Still another feature of the invention is a primary article of footwear for removably receiving a sandal within the primary article of footwear. The primary article of footwear includes an outsole and an upper attached to the outsole. The primary article of footwear also includes a midsole removably contained within the upper above the outsole, wherein the midsole is removable from the upper and can be worn independently as a sandal.

Another aspect of the invention is a method of converting a shoe into a sandal comprising the steps of providing a shoe with a removable midsole, said midsole having a strap, and removing the midsole from the shoe. The strap is moved from a stored position to a wearing position.

DETAILED DESCRIPTION OF PREFERRED EMBODIMENTS OF THE INVENTION

Figure 1:
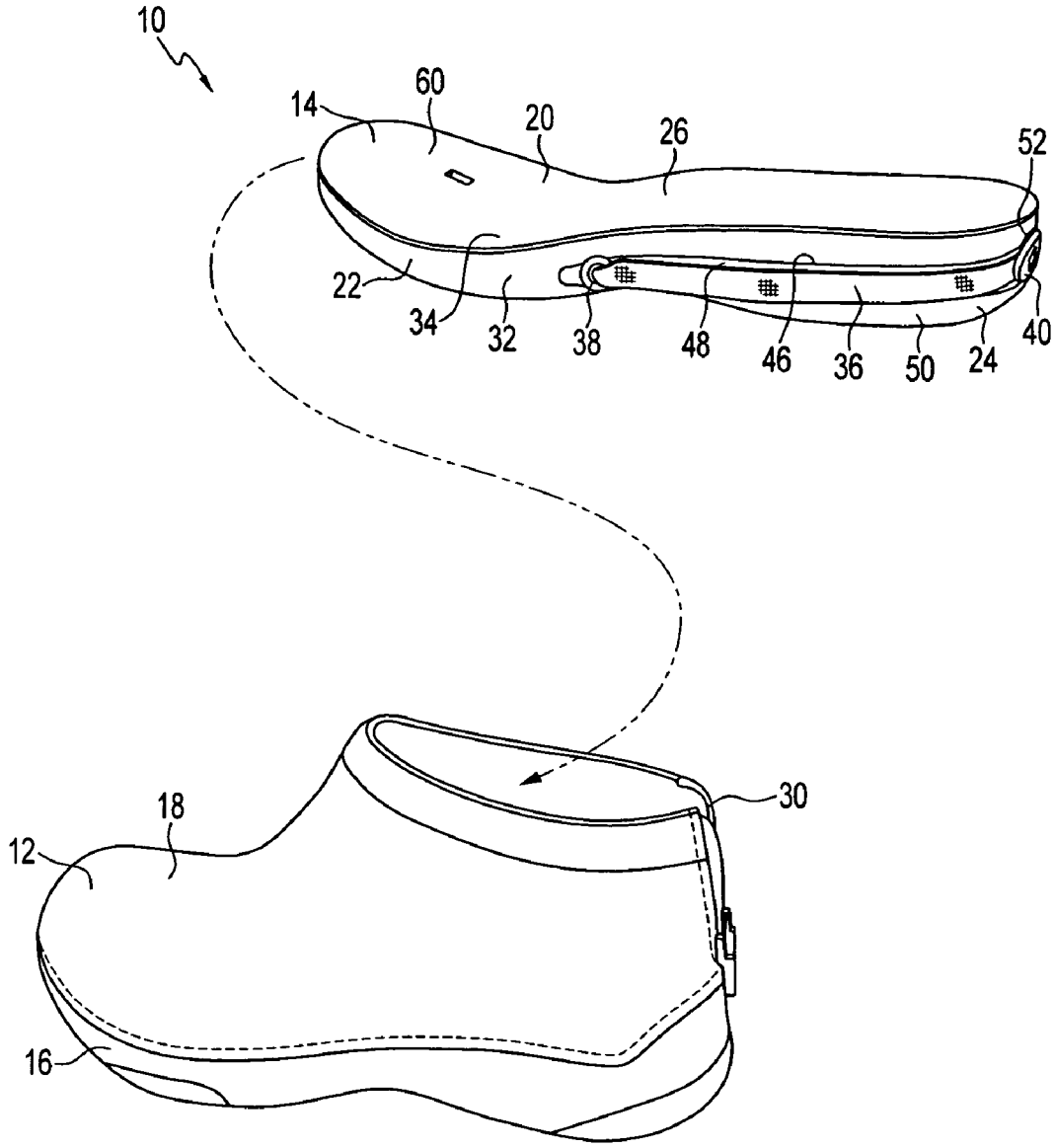
FIG. 1 is a perspective view of a convertible shoe of the present invention, where a sandal is removable from a primary article of footwear.

Referring to FIG. 1, a convertible article of footwear incorporating a primary article of footwear and a sandal that is removably inserted into the primary article of footwear is generally designated 10. The convertible article of footwear 10 can be worn with the primary article of footwear 12 and the sandal 14 assembled, or the sandal 14 can be worn independently. An example of when the convertible article of footwear 10 can be used is during airline travel, when a user may want to wear the primary article of footwear 12 in the airport, but only wear the sandal 14 on the plane.

In FIG. 1, the primary article of footwear 12 is depicted as a low-rise boot, however it is contemplated that the primary article of footwear can be of any variety, such as a shoe, a clog, or even a sandal. The primary article of footwear 12, (hereinafter referred as "boot 12"), includes an outsole 16 and an upper 18. The boot 12 may also include a midsole (not shown) disposed above the outsole 16. Having generally the same size and shape as the outsole 16, the sandal 14 includes a sole 20 with a forefoot portion 22, a heel portion 24 and a midfoot portion 26. The sandal 14 fits into the boot 12 above the outsole 16, and within the upper 18.

When the sandal 14 is removably inserted into the boot 12, the sole 20 forms a midsole of the boot. Alternatively, the sole 20 may form a sockliner or insole if the boot 12 already includes a midsole (not shown). Thus, the boot 12 is constructed and arranged to receive the sandal 14, and to accommodate the sole 20 of the sandal within the boot 12. When inserted into the boot 12, the periphery of the sandal 14 fits snugly within the boot 12. Further, the upper 18 is sized and designed to accommodate a user's foot within the boot while the sandal 14 is disposed within the boot.

A vent 30 is preferably provided in the upper 18 to facilitate access to the sandal for removing the sandal from within the boot. The vent 30 can be provided with a fastener 31 such as a zipper. It is contemplated that any other fastener, such as laces, Velcro®, elastic, and snaps, or any other closure means may be used. A handle (not shown), such as a looped piece of woven fabric, may be disposed on the sandal 14 to facilitate grasping and manually pulling the sandal from within the boot 12.

Preferably, the sole 20 of the sandal 14 is configured to the profile of the plantar surface of the human foot, and preferably comprises a main sole 32 and an insole 34. The main sole 32 is preferably fabricated from stiff and resilient material, such as polyurethane, dual density SSR rubber, vulcanized rubber or ethyl vinyl acetate (EVA), and may include a plurality of different materials in different locations to provide varying amounts of support to different parts of the foot. Further, the insole 34 may be provided with a microban zinc based anti-microbial protectant. In addition, other elements such as shock pads and shanks may be incorporated in the sole 20, as is well known in the art.

Figure 2:
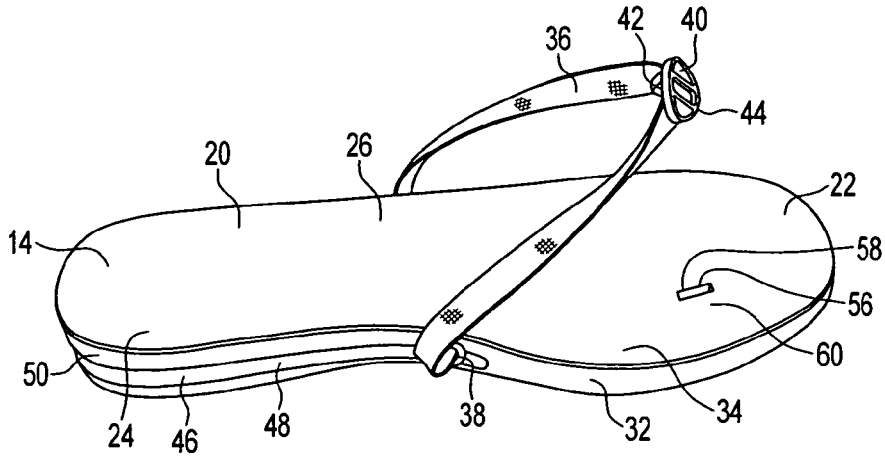
FIG. 2 is a perspective view of the sandal of FIG. 1.

Referring to FIG. 2, at least one strap 36 is fabricated from any suitable flexible material having a tensile strength sufficient to maintain the sandal 14 on the user's foot, such as woven fabric or leather, or any material known in the art. In the preferred embodiment, the strap 36 is preferably a single, continuous strap that is attached to the sole 20. However, multiple straps 36 may be attached to the sole 20.

As can be seen in FIG. 1, a closed-channel 38 extends transversely through the sole 20, preferably through the midfoot portion 26. In the preferred embodiment, the strap 36 is fed through the closed-channel 38 and forms a complete loop that is permanently retained within the sole 20, and the strap is prevented from movement within the sole. However, the strap 36 may be permitted to move within the closed-channel 38. Other ways of attaching the strap 36 to the sole 20 are also contemplated, such as fixedly attaching the strap to the sole with adhesive.

Referring now to FIG. 2, preferably slidably disposed on the strap 36 is an anchor 40 for securing the strap in a wearing position, as will be discussed later. The anchor 40 is preferably a "buckle"-like member that receives the strap 36 in an aperture structure 42, and preferably has a length longer than a width. The anchor 40 is preferably made of a metal or plastic, and preferably has a smooth contoured peripheral edge 44.

Figure 3:
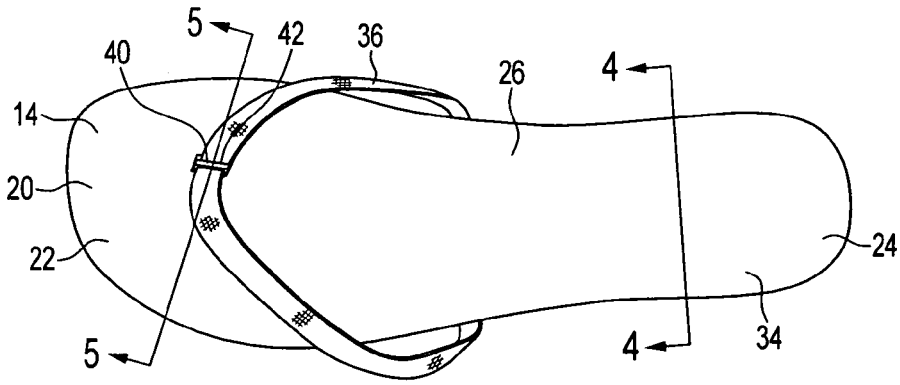
FIG. 3 is a top view of the sandal of FIG. 1.
Figure 4:
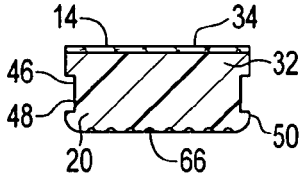
FIG. 4 is a cross-section of the sandal taken along line 4—4 of FIG. 3.

In the sandal 14 of the present invention, the strap 36 can be moved from a storage position when the sandal is disposed within the boot 12 (as seen in FIG. 1), to a wearing position when the strap is used for retaining a foot (as seen in FIG. 3).

FIG. 1 shows the strap 36 stored in a storage means 46. The storage means 46 is preferably a structure including a channel 48 on a peripheral edge 50 of the sole 20, the storage means 46 preferably tucks the strap 36 tautly into the sides of the sole so that the strap does not significantly protrude from the peripheral edge. However, other storage means 46 are contemplated, such as fasteners, to store the strap 36 against the peripheral edge 50. Further, it is contemplated that the storage means 46 can retain the strap 36 on any other surface of the sandal 14 or within the boot 12.

Figure 6:
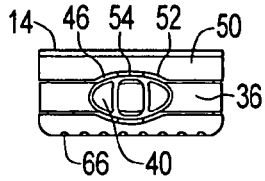
FIG. 6 is a back elevation view of the sandal of FIG. 1.

As can be seen in FIG. 6, the storage means 46 includes an anchor cavity 52. In the preferred embodiment, the anchor cavity 52 is an enlarged portion of the channel 48 at the back peripheral edge 50 of the sandal 14 which is sized and shaped to receive the anchor 40. The anchor cavity 52 preferably has a secondary cavity 54 which can accept the aperture structure 42 of the anchor 40. When the anchor 40 is disposed in the anchor cavity 52, preferably the anchor does not significantly protrude from the peripheral edge 50.

When the user removes the strap 36 from the stored position in the storage means 46, the user applies a slight pressure to remove the strap 36 from the channel 48, and brings the strap forward into a wearing position (See FIG. 2). The strap 36 is extended toward the forefoot portion 22 of the sole 20.

Figure 5:
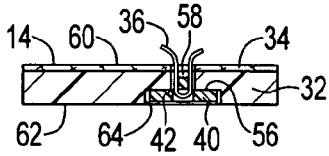
FIG. 5 is a cross-section of the sandal taken along line 5—5 of FIG. 3.

Referring to FIGS. 2 and 5, a receiving means 56 receives or engages the strap 36, and more preferably the anchor 40 and the strap, at the forefoot portion 22. In the preferred embodiment, the receiving means 56 is a structure that includes a hole 58 from a top surface 60 to a bottom surface 62 of the sole 20, and a detent 64 in the bottom surface. The detent 64 has a geometry generally corresponding to the geometry of the anchor 40. When the anchor 40 is fed through the hole 58, it has a first orientation generally transverse to the plane of the sole 20, and when the anchor is seated in the detent 64, it has a second orientation generally parallel to the plane of the sole 20. The user applies pressure to push the anchor 40 through the hole 58. In the preferred embodiment, the sole 20 surrounding the receiving means 56 is made of a different material than other portions of the sole to facilitate the entry and exit of the anchor 40.

The receiving means 56 is constructed and arranged to receive the strap 36 without protruding from the top surface 60 of the insole 34. The receiving means 56 preferably should not protrude from the top surface 60 because when the sandal 14 is used as the midsole 28 of the boot 12, the receiving means should not interfere with foot placement inside the boot. Further, the receiving means 56 preferably should not protrude from the bottom surface 62 so as not to interfere with a tread 66 disposed on the bottom surface. Other types of receiving means 56 are also contemplated, such as a hook for hooking the strap into the wearing position. Any mechanical device for releasably holding the strap to the forefoot is considered "receiving means" for the purposes of this application.

Although the sandal 14 is depicted as a having a "thong"-strapping configuration, other strapping configurations are contemplated. Further, in an embodiment with multiple straps 36, all or some may have a stored position and a wearing position. In yet another embodiment, the strap 36 may have a stored position that is pulled taut against the top surface 60 of the sole 20 from the bottom surface 62 or the peripheral edge 50.

While specific embodiments of the convertible article of footwear 10, the primary article of footwear 12, the sandal 14, and the strapping system of the present invention have been shown and described, it will be appreciated by those skilled in the art that changes and modifications may be made thereto without departing from the invention in its broader aspects and as set forth in the following claims.

What is claimed is:

1. A convertible article of footwear comprising:

a primary article of footwear having an outsole and an upper attached to said outsole; and a sandal having at least one strap, said sandle removably inserted into said primary article of footwear and disposed above said outsole, said sandal forming a midsole of said primary article of footwear;

wherein upon removal of said sandal from said primary article of footwear, said sandal can be worn independently of said primary article of footwear; and wherein said sandal further comprises a sole having a storage means for storing said strap in a stored position, and a receiving means for receiving said strap in a wearing position.

2. The convertible article of footwear of claim 1 wherein said storage means comprises a channel on a peripheral edge of said sole for retaining said strap.

3. The convertible article of footwear of claim 1 wherein said storage means comprises a cavity for receiving a strap anchor.

4. The convertible article of footwear of claim 1 wherein said receiving means comprises a hole in a forefoot portion of the sole to receive said strap.

5. The convertible article of footwear of claim 1 further comprising an anchor disposed on said strap wherein said anchor engages said receiving means.

6. The convertible article of footwear of claim 5 wherein said sandal comprises a sole having a top surface and a bottom surface, wherein said receiving means comprises a hole from said top surface to said bottom surface and a detent in said bottom surface, wherein said detent has a geometry generally corresponding to the geometry of said anchor, wherein said anchor is fed through said hole in a first orientation and seated in said detent in a second orientation.

7. The convertible article of footwear of claim 1 further comprising a vent in said upper of said primary article of footwear to provide access to insert or remove said sandal from said primary article of footwear.

8. The convertible article of footwear of claim 1 wherein said primary article of footwear has a midsole disposed above said outsole, and said primary article of footwear can be worn independently of said sandal.

9. A sandal for removable insertion into a primary article of footwear, comprising:

a sole having a strap storage structure and a strap receiving structure; and at least one strap connected to said sole for retaining a user's foot;

wherein when said sandal is disposed in the primary article of footwear, said strap is stored in the storage structure of said sole, and when said sandal is removed from the primary article of footwear, said strap can be moved to the receiving structure of said sole and said sandal can be worn independently of the primary article of footwear; and wherein said storage structure comprises a channel on a peripheral edge of said sole for retaining said straps.

10. The sandal of claim 9 wherein said storage structure further comprises an anchor cavity.

11. The sandal of claim 9 wherein said receiving structure comprises a hole in a forefoot portion of the sole to receive said strap.

12. The sandal of claim 9 further comprising an anchor disposed on said strap wherein said anchor engages said receiving structure.

13. The sandal of claim 12 wherein said sole comprises a top surface and a bottom surface, and said receiving structure comprises a hole from said top surface to said bottom surface and a detent in said bottom surface, wherein said detent has a geometry generally corresponding to the geometry of said anchor, and said anchor is fed through said hole in a first orientation and seated in said detent in a second orientation.

14. The sandal of claim 12 wherein when said strap is received in said receiving structure, the strap forms a thong strapping configuration.

15. The sandal of claim 9 wherein said sole has a peripheral edge and a top surface, and when said strap is stored in said storage structure, said strap is generally flush with said peripheral edge and said strap does not protrude to said top surface.

* * * * *